United States Patent [19]

Hauschopp

[11] Patent Number: 4,561,697

[45] Date of Patent: Dec. 31, 1985

[54] GUIDES FOR MINERAL MINING

[75] Inventor: Alois Hauschopp, Werne, Fed. Rep. of Germany

[73] Assignee: Gewerkschaft Eisenhutte Westfalia, Lunen, Fed. Rep. of Germany

[21] Appl. No.: 553,696

[22] Filed: Nov. 21, 1983

[30] Foreign Application Priority Data

Nov. 27, 1982 [DE] Fed. Rep. of Germany ..... 3244039

[51] Int. Cl.[4] ..... E21C 35/20

[52] U.S. Cl. ..... 299/43; 299/32

[58] Field of Search ..... 299/43, 42, 34, 32

[56] References Cited

U.S. PATENT DOCUMENTS

| | | | |
|---|---|---|---|
| 3,343,880 | 9/1967 | Hauschopp | 299/34 |
| 3,378,306 | 4/1968 | Lobbe | 299/34 |
| 3,897,108 | 7/1975 | Krohm et al. | 299/43 |
| 4,063,782 | 12/1977 | Bahre | 299/43 |
| 4,391,471 | 7/1983 | Hauschopp et al. | 299/34 |

FOREIGN PATENT DOCUMENTS

| | | | |
|---|---|---|---|
| 2607350 | 9/1977 | Fed. Rep. of Germany | 299/42 |
| 2712486 | 9/1978 | Fed. Rep. of Germany | 299/34 |
| 2086963 | 5/1982 | United Kingdom | 299/34 |

*Primary Examiner*—Stephen J. Novosad
*Assistant Examiner*—M. Goodwin
*Attorney, Agent, or Firm*—Maurice E. Gauthier

[57] ABSTRACT

A guide for a mineral mining machine, such as a plough, is composed of guide structures at the mineral face sides of the pans of a scraper-chain conveyor. Each guide structure defines upper and lower passages through which a chain for driving the machine passes. The passages are closed off from the mineral face side by a side plate or cover and from the top by means of a head plate. The head plate is detachable and is secured to, or located against, the side plate. The head plate and side plate have upstanding projections which form part of a guide rail for the machine. A foot plate projects beneath the lower passage to support the machine on the floor of a mine working. The guide structure preferably has reinforced end pieces fabricated by casting and the head plate lies between corresponding wall portions of these castings.

19 Claims, 1 Drawing Figure

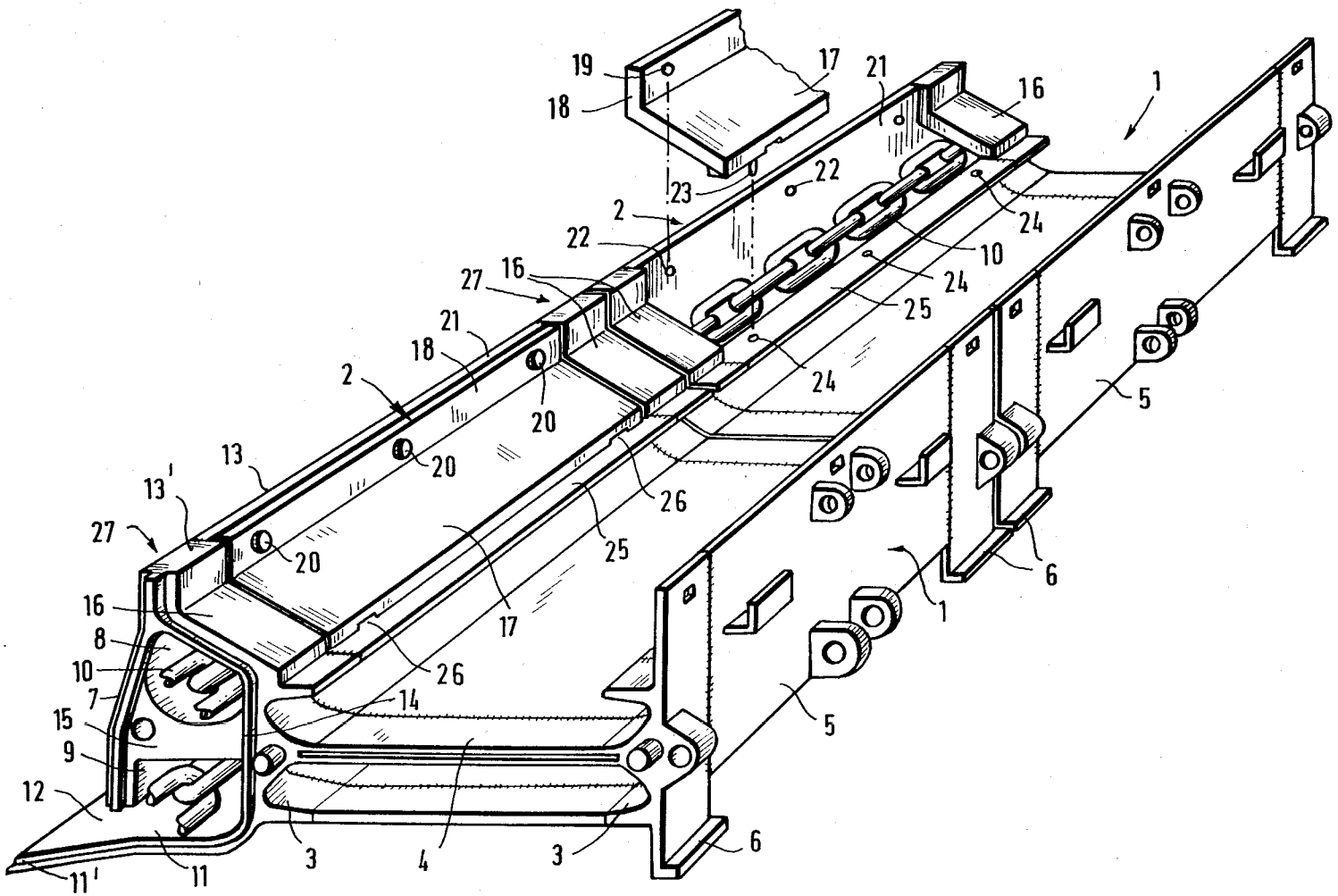
1
5
6
1
5
6
3
4
3
11
11'
12
9
15
7
10
8
16
27
13'
13
20
20
20
2
18
21
27
16
22
2
23
22
17
19
18
16
21
17
24
10
24
25
24
26
25
26
14

GUIDES FOR MINERAL MINING

BACKGROUND TO THE INVENTION

The present invention relates, in general, to mineral mining installations and, more particularly, to guides for mineral winning and/or loading machines.

It is well known to attach assemblies to the mineral face side of a scraper-chain conveyor in an underground mine working to provide a guide for a machine, such as a "swordless" plough. The machine or plough is usually driven along the guide with the aid of a chain running in upper and lower passages or channels within the guide itself. The individual assemblies can correspond to the channel sections or pans of the conveyor. The passages can be at least partly covered from the mineral face side by side covers which can be pivotable and/or detachable. These side covers can then provide a ramp-like side surface for the guide. A construction of this type is described in U.S. patent application Ser. No. 249,315, now U.S. Pat. No. 4,391,471, assigned to the same assignee as the present application.

A general object of the present invention is to provide an improved guide for a mineral mining machine.

SUMMARY OF THE INVENTION

A guide constructed in accordance with the invention comprises means defining upper and lower chain passages, a side cover covering at least the upper passage laterally and head plates for covering the upper passage from above; wherein the head plates are detachable and are located by or secured to the side cover. The side cover can itself be made up from side plates each associated with one of the head plates. In contrast to known constructions, these side plates can be fixed in position since the passages can be easily exposed by removing one or more of the head plates. This provides a simple, yet, highly stable construction and the avoidance of pivoting the side covers for access is advantageous, especially in cases where the mineral face gangway is otherwise obstructed. Nevertheless, the side plates can still be mounted by way of push-in hinges as is known. The side cover can be made more or less continuous along the guide.

Conveniently, the head plates may have flanges which abut upper regions of the side plates and nuts and bolts can engage through aligned holes in these flanges and upper regions. These latter parts can project upwardly to form a web-like guide strip or rail for guidance of the machine. In known manner, the guide preferably has foot plates or their equivalent beneath the lower passages and projecting outwardly to engage on the floor of the mine working to support the machine.

To facilitate the location of the head plates, the latter may possess locating means such as pins or pegs engaging in holes in, say, the mineral face side wall of a scraper-chain conveyor. The head plates can then take up a position inclined from the side wall up to the side cover. The inclined upper surfaces of the head plates can then act to transfer mineral ore, e.g. coal, from the machine to the conveyor. These upper surfaces can however adopt a near horizontal position thereby effectively increasing the size of the upper chain guide passage. This is advantageous at least over end regions of the guide since it permits the upper run of the chain to pass onto a chain wheel of a drive station without undue deflection.

In a preferred construction the guide is made up of assemblies or structures each provided on the mineral face side of a channel section or pan. Each head plate would then be somewhat shorter than the associated guide structure and mounted between corresponding wall portions at the ends of the structure. Conveniently these wall portions are parts of reinforced end pieces fabricated by casting and other wall portions can form part of the side cover and of the foot plate support.

In accordance with another aspect of the invention each guide structure or unit comprises a one-piece casting composed of means for defining the upper and lower passages, at least one side wall portion forming part of said side cover and spaced apart upper wall portions between which one of the head plates is mounted; and wherein the side wall portion extends upwardly beyond the upper wall portions and the head plate has a web abutting the side wall portion and forming therewith part of a guide rail for the machine.

The invention may be understood more readily, and various other aspects and features of the invention may become apparent, from consideration of the following description.

BRIEF DESCRIPTION OF DRAWING

An embodiment of the invention will now be described, by way of example only, with reference to the accompanying drawing, which is a schematic, perspective view of part of a conveyor employing a guide constructed in accordance with the invention.

DESCRIPTION OF PREFERRED EMBODIMENTS

As shown in the drawing, a conveyor is composed of individual units 1 defining both channel sections or pans along which a scraper-chain assembly (not shown) is circulated in known manner and a guide 2 on the mineral face side. The units 1 are arranged end-to-end. The channel section defining part of each unit 1 is composed of a pair of side walls 3 and a deck or floor plate 4 extending therebetween. The walls 3 are generally sigmashaped in cross-section and the deck plate 4 joins the central inwardly-projecting flanges thereof. Each unit 1 has a guide structure on its mineral face side and these structures combine to form the more or less continuous guide 2. A machine, such as a plough, is mounted on the guide 2 for movement back and forth along the mineral face.

At the side of each unit 1 opposite the guide structure, there is a barrier plate 5.

The unit 1 has reinforced end pieces 27 each composed of one or more one-piece castings. The end pieces 27 are welded to a central region of the unit. The parts of the end pieces 27 which form the end regions of the barrier plate 5 have projections at their lower ends which form support feet 6 resting on the floor of the mine working.

The guide structure of each unit 1 defines upper and lower chain guides passages 8,9 along which a drive chain 10 moves to propel the machine. The passages 8,9 are defined laterally by the mineral face side wall of the channel section of the unit 1 and by a side cover 7. An inclined foot plate 11 with a portion 11' engaging on the floor of the working extends beneath the lower passage 9 and projects outwardly beyond the side cover 7 towards the mineral face. The foot plate 11 has an upstanding portion 14 fixed to, or integral with, the mineral face side wall of the channel section. The side cover 7 terminates above the foot plate 11 to establish a gap 12 through which a component of the machine locates to make connection with the lower haulage run of the chain 10 in the passage 9. The side cover 7 projects upwardly beyond the passage 8 to provide a web-like guide strip 13, 13' which combine with similar strips of adjacent units to form a guide rail for the machine.

The passages 8,9 are separated by means of guide blocks or spacers 15 extending between the portions 14 of the foot plates 11 and the side cover 7. The spacers 15 are spaced apart along the conveyor with each unit 1 having spacers 15 at the end pieces 27 and possibly one or more intermediate spacers 15 therebetween.

The side cover 7 and the foot plate 11 are formed by wall portions integral with the cast end pieces 27 and by plates therebetween. The upper passage 8 of each unit 1 is covered over at the upper side by means of wall portions 16 of the end pieces 27 and a detachable head plate 17 mounted between the portions 16 to merge therewith. The portions 16 and the plates 17 incline from the upper flange 25 of the mineral face side wall of the channel section of the strips 13, 13'. The plates 17 have upstanding flanges or webs 18 which combine with similar margins of the plates of the side cover 7 to provide the guide strips 13. In contrast, the guide strips 13' are integral with the end pieces 27 and the gaps 21 between the strips 13 of the end pieces 27 receive the abutting flanges and margins of the side plates and head plates 17 providing the strips 13.

The flanges 18 of the head plates 17 have holes 19 and the upper margins of the side plates of the side cover 7 have similar mating holes 22. Nuts and bolts 20 engage through these holes 19, 22, which are preferably countersunk, to secure the head plates 17 in position. The head plates 17 also have pins 23 on their undersides which engage in holes 24 in the upper flanges 25 of the mineral face side walls. By removing the bolts 20 one or more of the plates 17 can be lifted clear to expose the passages 8,9. To facilitate this, the rear edges of the plates 17 have recesses 26 which permit a lever, a bar or similar tool to be used. As an alternative, lugs or the like could be provided on the plates 27 to facilitate their lifting. In further possible constructions the pins 23 can be replaced by bolts or screws or by spring fasteners or the bolts 20 and the pins 23 could be transfused.

Instead of making each unit 1 with cast end pieces 27 as shown, the entire unit 1 with the exception of the head plate 17 can be a single or multi-part casting.

In another construction, the passage 8 is extended upwardly and the wall portions 16 and the head plate 17 are shaped differently to that shown with at least one region nearly parallel to the deck plate 4 leading to the strip 13, 13'. A passage 8 enlarged in this way is particularly useful at the ends of the guide since the chain 10 can pass practically without deflection onto a chain wheel of a machine frame.

I claim:

1. A guide for a mineral mining machine, said guide comprising: means defining upper and lower passages along which a drive chain is to be circulated, said means including a side cover covering at least the upper passage laterally and forming the mineral face side of an upwardly exposed guide surface along which the mineral mining machine is propelled by said drive chain, and a removable head plate for covering the upper passage solely from above, the head plate having an upper portion which forms the goaf side of said guide surface and which is attached to and at least partially located by the side cover, said head plate being separable from said side cover to expose the upper passage while leaving the side cover and its side of the guide surface intact.

2. A guide according to claim 1, wherein the side cover projects upwardly beyond the head plate and the head plate has a flange which engages on an upper region of the side cover.

3. A guide according to claim 2, wherein the flange of the head plate is detachably secured to the upper region of the side cover.

4. A guide according to claim 2, wherein the upper regions of the side cover and the flange of the head plate combine to form at least part of a guide rail for said machine.

5. A guide according to claim 3, wherein the flange of the head plate and the upper region of the side cover have alignable holes which receive screw-threaded fixing members.

6. A guide according to claim 1, wherein the head plate is provided with means for aligning said plate during its installation and assembly.

7. A guide according to claim 6, wherein said aligning means comprise pins which are engageable in holes.

8. A guide according to claim 1, wherein the head plate is mounted to incline downwardly away from the side cover.

9. A guide according to claim 1, wherein the defining means includes guide blocks disposed between the passages and spaced apart along the guide.

10. A guide according to claim 1, and further comprising at least one inclined foot plate disposed beneath the lower passage, said foot plate projecting outwardly beyond the side cover and serving to support the machine on the floor of a mine working.

11. A guide according to claim 10, wherein the side cover terminates above the foot plate to provide a gap to permit a drivable connection to be established between the machine and a haulage run of the drive chain in the lower passage.

12. A guide according to claim 1 and composed of individual guide structures arranged end-to-end, each guide structure being provided on one side of a channel section unit of a scraper-chain conveyor.

13. A guide according to claim 12, wherein each unit has reinforced end pieces each of which includes at least one one-piece casting providing part of the passage-defining means and part of the side cover.

14. A guide according to claim 13, wherein detachable side plates are disposed between wall portions of the castings each constituting said part of the side cover.

15. A guide according to claim 14, wherein the castings include further wall portions between which head plates are disposed to form a continuous top cover for the upper passage.

16. A guide according to claim 15, wherein said wall portions and said side plates project upwardly beyond the head plates, the head plates have flanges which abut upper regions of the side plates and the wall portions and the abutting regions and flanges form a guide rail for the machine.

17. A guide according to claim 13, wherein the castings also provide inclined lower wall portions disposed beneath the lower passage and projecting outwardly beyond the side cover with a gap therebetween; said lower wall portions combining with foot plates to support the machine on the floor of a mine working.

18. A guide according to claim 12, wherein each unit comprises a one-piece casting forming the associated guide structure, said casting being composed of said means for defining the upper and lower passages, at least one side wall portion forming part of said side cover and spaced apart upper wall portions between which said head plate is mounted; and wherein the side wall portion extends upwardly beyond the upper wall portions and the head plate has a web abutting the side wall portion and forming therewith part of a guide rail for the machine.

19. A guide according to claim 12, wherein each unit comprises one-piece castings at its ends, each casting being composed of said means for defining the upper and lower passages, a side wall portion forming a part of the side cover, an inclined wall portion disposed beneath the lower passage to form part of a foot plate support for supporting the machine on the floor of a mine working and an upper wall portion which forms a continuation of the head plate mounted between a pair of the upper wall portions of the castings and wherein a side plate is welded between the side wall portions.

* * * * *